US005809368A

United States Patent [19]

Menjo et al.

[11] Patent Number: 5,809,368

[45] **Date of Patent: *Sep. 15, 1998**

[54] IMAGE FORMING APPARATUS CAPABLE OF FORMING AN IMAGE HAVING A PLURALITY OF COLORS ON A LIGHT-TRANSMITTING RECORDING MATERIAL

[75] Inventors: Takeshi Menjo, Tokyo; Rie Saito, Yokohama; Jiro Ishizuka, Chiba; Mitsuhiro Ota, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 780,962

[22] Filed: Jan. 10, 1997

[30] Foreign Application Priority Data

Jan. 12, 1996 [JP] Japan ..... 8-020715

[51] Int. Cl.[6] ..... G03G 15/20

[52] U.S. Cl. ..... 399/68; 399/45; 399/400

[58] Field of Search ..... 399/67, 68, 69, 399/328, 331, 335, 396, 400, 45; 219/216

[56] References Cited

U.S. PATENT DOCUMENTS 5,075,732 12/1991 Menjo .
5,138,392 8/1992 Kinoshita et al. .
5,249,024 9/1993 Menjo .
5,260,751 11/1993 Inomata ..... 399/68
5,374,983 12/1994 Isogai .
5,493,378 2/1996 Jamzadeh et al. .

*Primary Examiner*—R. L. Moses
*Attorney, Agent, or Firm*—Fitzpatrick, Cella, Harper & Scinto

[57] ABSTRACT

An image forming apparatus includes an unfixed-image forming unit for forming an unfixed image having a plurality of colors on a recording material, and a fixing unit for fixing the unfixed image formed by the unfixed-image forming unit by heating the recording material bearing the image. The fixing unit can fix the unfixed image on the recording material with a first degree of fixing or with a second degree of fixing which is greater than the first degree of fixing depending on whether or not a light-transmitting-property recognition unit recognizes the recording material to have a light-transmitting property, and whether or not a black-monocolor recognition unit recognizes the unfixed image formed by the unfixed-image forming unit as a black monochromatic image. When the image forming apparatus recognizes that the recording material has a light-transmitting property and that the unfixed image is a black monochromatic image, the fixing unit can fix the unfixed image with the first degree of fixing or with the second degree of fixing based on information relating to an image formed by the fixing unit.

47 Claims, 4 Drawing Sheets

IMAGE FORMING APPARATUS CAPABLE OF FORMING AN IMAGE HAVING A PLURALITY OF COLORS ON A LIGHT-TRANSMITTING RECORDING MATERIAL

BACKGROUND OF THE INVENTION

1. Field of the Invention

This invention relates to an image forming apparatus having fixing means for fixing an unfixed image on a recording material formed according to an electrophotographic method, an electrostatic recording method or the like. For example, the invention is suitably applied to a color electrophotographic copier or printer.

2. Description of the Related Art

In conventional image forming apparatuses, such as color electrophotographic copiers or the like, image information is subjected to color separation for respective colors, and electrostatic latent images are formed on an image bearing member, such as a photosensitive drum or the like, for respective colors according to laser exposure or the like, and are developed by a developing device using toners of four colors, i.e., a magenta toner, a cyan toner, a yellow toner and a black toner. Toner images of the respective colors are transferred onto a recording material by a transfer device in a state of being laminated. The undeveloped toner images are mixed and fixed by fusing the toners by heat by a fixing device to provide a full-color image. It is also possible to form a monochromatic or multicolor image by appropriately selecting one or at most three of the toners.

Particularly, when forming an image on a light-transmitting resin-like recording material, such as a transparent sheet for an overhead projector (hereinafter termed an "OHP sheet"), it is necessary to increase the transmittance of toners by fusing them, because the image on the OHP is projected on a screen utilizing the difference in contrast between the transmittance of the OHP sheet and that of the toner image. In the case of a color image, if toners are fixed by being sufficiently heated and fused, the transmittance of the toners increases, and an excellent colorproducing property is obtained in the projected image provided by light passing through the toner image on the OHP.

When using an OHP sheet, in order to sufficiently heat and fuse undeveloped toners on the OHP sheet so that the fixed image has a sufficient transmittance, the fixing speed of the fixing device is generally arranged to be indiscriminately smaller than the fixing speed when using an opaque recording material, such as paper or the like, whether a monochromatic image or a multicolor image is formed. Hence, the speed for forming the entire image, i.e., the image processing speed, is greatly reduced.

For example, when fixing an unfixed image on paper or the like, fixing is performed at a fixing speed of 133 mm/sec which is the same as the speed of the photosensitive drum and the unfixed-image forming means, such as the transfer device or the like, and when fixing an unfixed image on an OHP sheet, the fixing speed is reduced to 30 mm/sec.

Accordingly, while image formation can be performed at an image processing speed of 7 sheets per minute for paper or the like, only about one sheet per minute can, in some cases, be processed for OHP sheets.

In order to solve such a problem, a method has been proposed in which, even when using an OHP sheet, if the concerned image is recognized to be a black monochromatic image, fixing is performed at the same fixing speed as the speed for paper, in order to increase the speed of image formation under certain conditions. In this method, however, when forming a photographic image on an OHP sheet and projecting the image onto a screen, the projected image becomes blackish, and therefore the original image cannot be well reproduced.

SUMMARY OF THE INVENTION

It is an object of the present invention to provide an image forming apparatus in which, when forming a black monochromatic image on an OHP sheet, a line image can be clearly formed while increasing the image processing speed as much as possible, and a halftone image can also be well reproduced.

According to one aspect, the present invention which achieves the above-described object relates to an image forming apparatus comprising unfixed-image forming means for forming an unfixed image having a plurality of colors on a recording material, and fixing means for fixing the unfixed image formed by the unfixed-image forming means by heating the recording material bearing the image. The fixing means can fix the unfixed image on the recording material with a first degree of fixing or with a second degree of fixing which is greater than the first degree of fixing. The apparatus also comprises light-transmitting-property recognition means for recognizing whether or not the recording material has a light transmitting property, and black-monocolor recognition means for recognizing whether or not the unfixed image formed by the unfixed-image forming means is a black monochromatic image. When the image forming apparatus recognizes that the recording material has a light-transmitting property using the light-transmitting-property recognition means and that the unfixed image is a black monochromatic image using the black-monocolor recognition means, the fixing means can fix the unfixed image with the first degree of fixing or with the second degree of fixing based on information relating to an image formed by the fixing means.

According to another aspect, the present invention which achieves the above-described object relates to an image forming apparatus comprising unfixed-image forming means for forming an unfixed image on a recording material, fixing means for fixing the unfixed image formed by the unfixed-image forming means on the recording material with a first degree of fixing or with a second degree of fixing which is greater than the first degree of fixing, first determination means for determining whether or not the recording material has a light-transmitting property, second determination means for determining whether or not the unfixed image on the recording material is a black monochromatic image, and third determination means for determining whether or not the image formed on the recording material is a halftone image. A degree of fixing of the fixing means is selected based on results of the determination by the first, second and third determination means.

According to still another aspect, the present invention which achieves the above-described object relates to an image forming apparatus comprising unfixed-image forming means for forming an unfixed image on a recording material, fixing means for fixing the unfixed image formed by the unfixed-image forming means on the recording material with a first degree of fixing or with a second degree of fixing which is greater than the first degree of fixing, first determination means for determining whether or not the recording material has a light-transmitting property, second determination means for determining whether or not the unfixed image on the recording material is a black monochromatic image, and third determination means for determining whether or not the image formed on the recording material is a line image. A degree of fixing of the fixing means is selected based on results of the determination by the first, second and third determination means.

According to still another aspect, the present invention which achieves the above-described object relates to an image forming apparatus comprising unfixed-image forming means for forming an unfixed image on a recording material, fixing means for fixing the unfixed image formed by the unfixed-image forming means with a first degree of fixing or with a second degree of fixing which is greater than the first degree of fixing, first determination means for determining whether or not the recording material has light-transmitting property, and second determination means for determining whether or not the image formed on the recording material is a halftone image. When the first determination means and the second determination means determine that the recording material has a light-transmitting property and that the image fixed on the recording material is a halftone image, respectively, the fixing means fixes the unfixed image at the second degree of fixing.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described in detail with reference to the drawings.

First Embodiment

Figure 1:
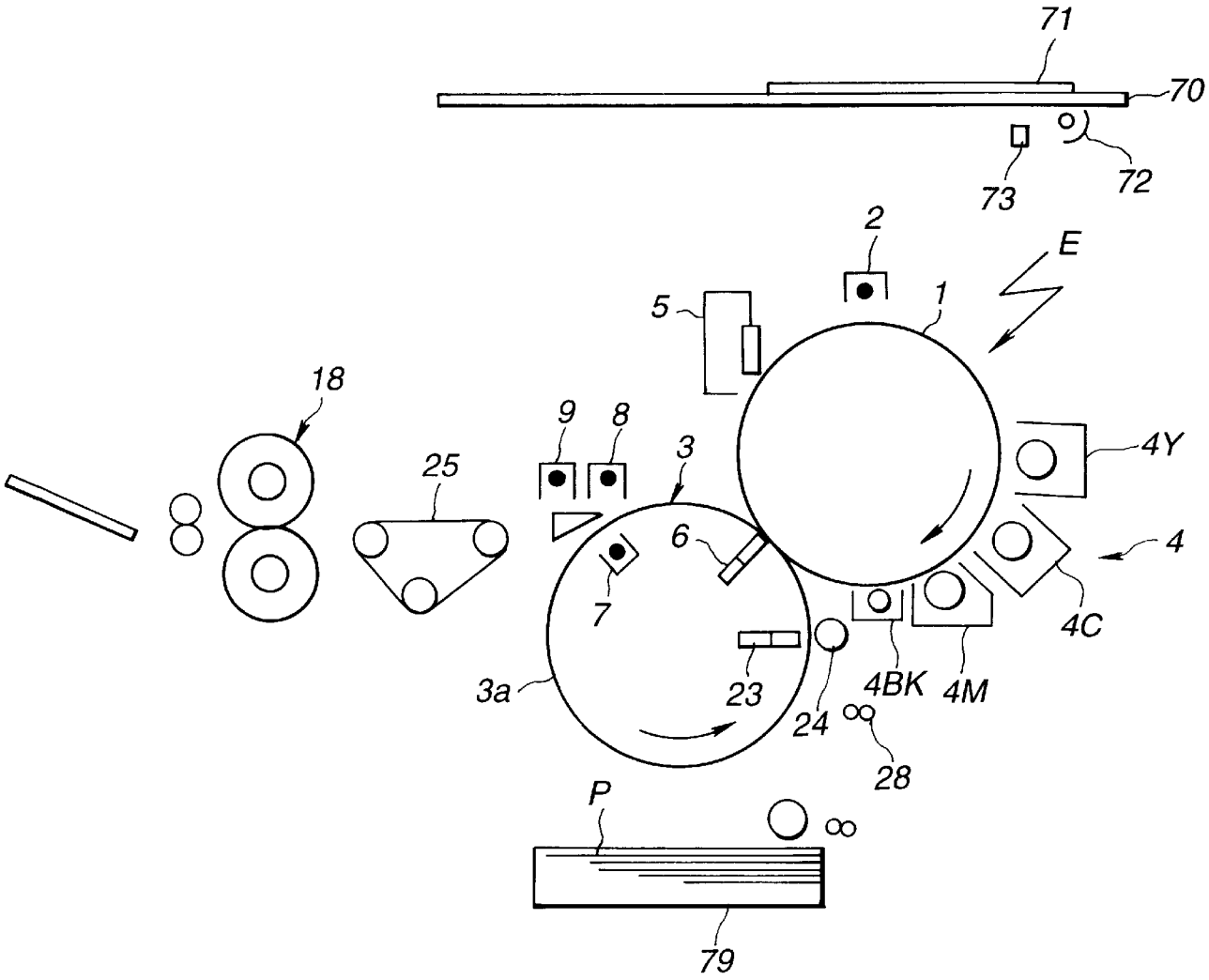
FIG. 1 is a schematic cross-sectional view illustrating a color-image copier according to a first embodiment of the present invention.

First, a first embodiment of the present invention will be described with reference to FIGS. 1 and 2. FIG. 1 is a schematic diagram illustrating a color electrophotographic copier using a laser-beam exposure device, serving as an image forming apparatus according to the first embodiment.

In this copier, an original 71 mounted on original-mount glass 70 is illuminated by a tungsten halogen lamp 72, and light reflected from the original 71 is read by an image reading sensor 73, such as a CCD (charge-coupled device) or the like. Image information obtained by reading the image of the original by the image reading sensor 73 is converted into color separation signals for respective colors according to a known image processing method.

An exposure device (not shown), such as a laser-beam exposure device or the like, projects a laser beam E onto a photosensitive drum 1, serving as an image bearing member, in accordance with the color separation signals, and an electrostatic latent image is formed on the outer surface of the photosensitive drum 1 uniformly charged by a primary charger 2.

Since the photosensitive drum 1 rotates in the direction of the arrow while being supported on a shaft, the electrostatic latent image is conveyed to a portion facing a developing device 4, and is developed by the developing device 4 to provide a visualized toner image. The developing device 4 has four developing units 4Y, 4C, 4M and 4Bk for accommodating respective toners of four colors, i.e., yellow, cyan, magenta and black. The electrostatic latent image on the photosensitive drum 1 is developed by sequentially making a desired one of the developing units 4Y, 4C, 4M and 4Bk to approach a position facing the outer circumference of the photosensitive drum 1.

When a sheet of a transfer material P, serving as a recording material, accommodated within a sheet feeding cassette 79 is supplied at an appropriate timing by a registration roller 28, the transfer material P is carried on a transfer device 3 and is conveyed in the direction of the arrow. That is, for example, a transfer sheet 3*a*, such as a dielectric sheet or the like, is stretched on a cylindrical drum frame. The transfer material P is attracted and held on the transfer sheet 3*a* of the transfer device 3 by a charger 23 for attraction and a conductive roller 24, and is conveyed to a portion facing the photosensitive drum 1.

By applying a voltage having a polarity opposite to the polarity of the toner from behind the transfer material P by a charger 6 for transfer, the toner image on the photosensitive drum 1 is moved and transferred onto the transfer material P. Thus, an undeveloped image is formed on the transfer material P.

For example, in the case of a full-color image, when the toner image of a first color, for example, magenta, is transferred onto the transfer material P, the transfer material P having the transferred image is held on the transfer sheet 3*a*. The surface of the photosensitive drum 1 after transferring the toner image is cleaned by a cleaner 5 to remove adhering contaminants, such as untransferred toner particles and the like, and is again charged by the primary charger 2 in order to form the image of a second color.

Upon completion of exposure for the second color and development by the toner of the second color, for example, cyan, the transfer material P held on the transfer sheet 3*a* is again conveyed to the portion facing the photosensitive drum 1, and the toner image of the second color, i.e., cyan, is transferred onto the transfer material P in the above-described manner.

By repeating the above-described processing for the yellow toner and the black toner, the toner images of the four colors are transferred and laminated on the transfer material P.

When forming a monochromatic image, the above-described processing for forming an unfixed image is performed only for one color, and when forming an image of blue, red or the like, the above-described processing is performed only for two colors.

Upon completion of the transfer process in the above-described manner, in order to weaken the attracting force of the transfer material P with respect to the transfer sheet 3*a*, charges are removed from the transfer material P using a pair of AC corona dischargers 7 and 8 facing via the transfer sheet 3*a*, and the transfer material P is then separated from the transfer sheet 3*a*. At that time, in order to prevent disturbance in the image due to discharge caused by peeling generated when the transfer material P is separated from the transfer sheet 3*a*, AC corona discharge is performed using a corona discharger 9.

Upon completion of the above-described transfer and separation processes, the transfer material P is fed to a fixing device 18, serving as fixing means, via a conveying belt 25, serving as conveying means. The toners on the transfer material P are heated and pressed by the fixing device 18, and the toner image is thereby fixed.

Figure 2:
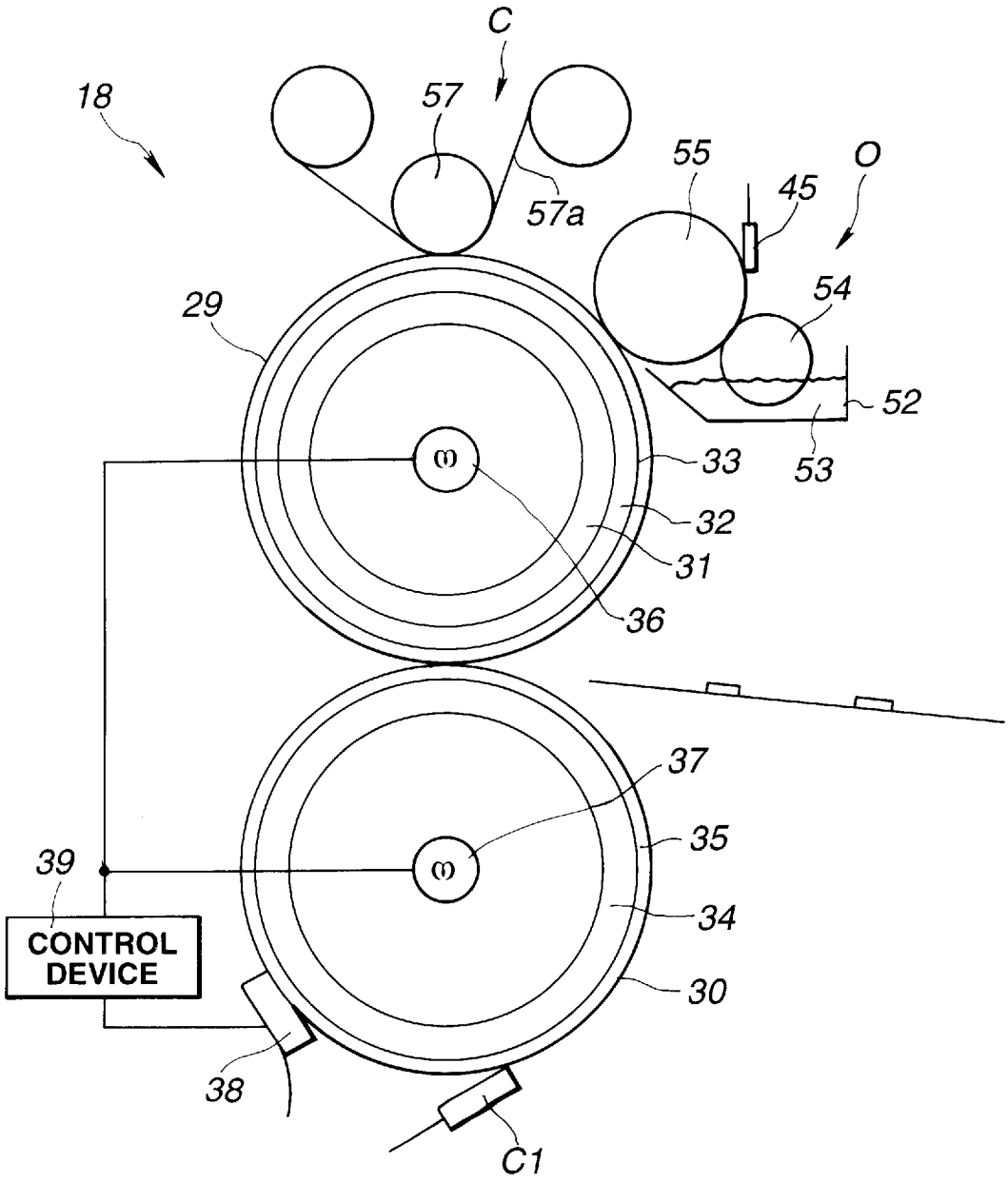
FIG. 2 is a schematic diagram illustrating a fixing device of the copier shown in FIG. 1.

FIG. 2 illustrates the detail of the fixing device 18. In FIG. 2, a fixing roller 29, serving as a rotating member for fixing, comprises HTV (high-temperature-vulcanized) silicone rubber 32 formed on an aluminum core 31, and addition LTV (low-temperature-vulcanized) silicone rubber 33 formed thereon to a thickness of 2 mm in total, and has a diameter of 60 mm. The addition LTV silicone rubber 33 comprises terminal-closed straight-chain dimethyl polysiloxane (40 weight parts) having a viscosity of $10^4$ poise, and resin-like organo-polysiloxane (60 weight parts) which is a ladder polymer).

A pressing roller 30, serving as pressing means, comprises HTV silicone rubber 1 mm thick formed on an aluminum core 34, and LTV silicone rubber 35, made of the same material as the surface-layer material of the fixing roller 29, formed thereon, and has a diameter of 60 mm.

Whether or not the toner and the binding resin have a sharp melting property can be determined by measuring the apparent melt viscosity of the toner or the binding resin. In general, a toner or a binding resin satisfying the following conditions is defined as a toner or a binding resin having a sharp melting property:

$T1=90-150°$ C.

$|\Delta T|=|T1-T2|=5-20°$ C., where T1 is the temperature when the apparent melt viscosity is $10^3$ poise, and T2 is the temperature when the apparent melt viscosity is $5\times10^2$ poise.

A halogen-lamp heater 36, serving as heating means, is disposed inside the core 31 of the fixing roller 29, and a halogen-lamp heater 37 is disposed inside the core 34 of the pressing roller 30, so that the transfer material P is heated from both sides. The temperature of the pressing roller 30 is detected by a thermistor 38 contacting the pressing roller 30. The halogen-lamp heaters 36 and 37 are controlled by a control device 39 based on the detected temperature, so that the fixing roller 29 and the pressing roller 30 are maintained at the same constant temperature of about 170° C. The fixing roller 29 and the pressing roller 30 are pressed against each other with a total pressure of 60 kg by a pressing mechanism (not shown) to form a nip. The transfer material P is grasped and conveyed by the nip.

In FIG. 2, there are also shown an oil coating device O, serving as releasing-agent coating means, a cleaning device C, and a cleaning blade C1 for removing oil and stain on the pressing roller 30.

The oil coating device 0 coats dimethyl silicone oil 53 (KF96-300cs made by Shin-Etsu Chemical Co., Ltd.) accommodated within an oil pan 52 on the fixing roller 29 using an oil drawing roller 54 and an oil coating roller 55 while regulating the amount of oil coating by an oil-coating-amount adjusting blade 45. In the case shown in FIG. 2, the amount of oil coating is adjusted to 0.02 g/A4-size.

The amount of coating of silicone oil 53 by the oil coating device 0 is obtained in the following manner.

That is, the weight of 50 white A4-size sheets is represented by A1 (g), and the weight of the 50 sheets after passing between the fixing roller 29 and the pressing roller 30 without transferring images onto the sheets and without coating silicone oil 53 on the rubber layer 33 of the fixing roller 29 is represented by B (g). The weight of another white A4-size sheets is represented by A2 (g), and the weight of the white sheets after passing between the fixing roller 29 and the pressing roller 30 without transferring images onto the sheets but with coating silicone oil 53 on the rubber layer 33 of the fixing roller 29 is represented by C (g).

The amount of coating X (g) of silicone oil 53 per white A4-size sheet is obtained according to the following equation using the weights A1, B, A2 and C:

$$X=(C+A1-B-A2)/50.$$

The cleaning device C cleans the surface of the fixing roller 29 by pressing a nonwoven-fabric web 57*a* made of Normex (product name) against the fixing roller 29 using a pressing roller 57. The web 57*a* is appropriately wound by a winding device (not shown), so that toner particles and the like are not accumulated on a portion contacting the fixing roller 29.

The toner on the transfer material P grasped and conveyed by the nip formed between the fixing roller 29 and the pressing roller 30 is heated and fused by the fixing device 18, and is fixed on the transfer material P without being offset on the fixing roller 29 by the function of the silicone oil 53.

In order to form an excellent multicolor or full-color image, it is necessary to sufficiently fuse and mix the toners laminated on the transfer material P as described above. Hence, a known sharp-melting toner is used as the toner.

A toner is manufactured by fusing, mixing, pulverizing and classifying toner forming materials comprising a binding resin, such as a polyester resin or a stainless-acrylic ester resin, a coloring agent (dye, sublimating dye) and a charge controlling agent. Various kinds of additives (for example, hydrophobic colloidal silica) are added to the toner if necessary.

As for a color toner, in consideration of fixability and a sharp melting property, a toner using a polyester resin as the binding resin is particularly preferred. The softening point of the sharp melting polyester resin is preferably 75°–159° C., and more preferably, 80°–120° C.

The sharp melting resin having the above-described temperature-melt viscosity characteristics has the feature of a very sharp decrease in the viscosity by being heated. Such a decrease in the viscosity allows appropriate mixture of the uppermost toner layer and the lowermost toner layer and an abrupt increase in the transmittance of the toner layer itself, thereby providing excellent subtractive color mixture.

When forming a color image on a light-transmitting resin-like transfer material, such as an OHP sheet or the like, by fixing the above-described sharp-melting toner by sufficiently heating and fusing so as to provide a higher degree of fixing than when fixing an image on paper, fine solid particles present in the toner layer can be fused, thereby increasing the transmittance of the OHP sheet. As a result, an excellent color-producing property can be obtained in a projected image on a screen formed by light transmitted through the OHP sheet.

Hence, conventionally, when using an opaque transfer material, such as paper or the like, fixing is performed with a first degree of fixing by setting the fixing speed of the fixing device 18, i.e., the rotational speed of the fixing roller or the conveying speed of the transfer material conveyed by the fixing nip, to the same speed as the speed of the photosensitive drum 1 and the transfer device 3, i.e., 133 mm/sec (a first speed). On the other hand, when using a light-transmitting resin-like transfer material, such as an OHP sheet or the like, fixing is performed with a second degree of fixing which is greater than the first degree of fixing by indiscriminately setting the fixing speed of the fixing device 18 to a speed of 30 mm/sec (a second speed) which is lower than the speed of the photosensitive drum 1 and the like, to perform sufficient heating and fusing, thereby providing the toners with a high transmittance.

In order to increase the degree of fixing, instead of increasing the heat quantity provided for a unit area by reducing the fixing speed in the above-described manner, the heat quantity provided for the transfer material in a unit time may be increased by raising the temperature of the heater, or the pressing force of the pressing roller may be increased.

However, while a color-producing property, i.e., a light-transmitting property, is required for certain types of images fixed on OHP sheets, such a property is not required for other types of images. Particularly, in the case of black monochromatic images, a light-transmitting property is, in most cases, unnecessary. That is, for line images (including character images), such as characters, graphs or the like, a light-transmitting property is not required at all, and only a property of blocking a black toner is required. That is, in the case of a line image, light need not be transmitted through a black toner when passing through an OHP sheet.

Figure 3:
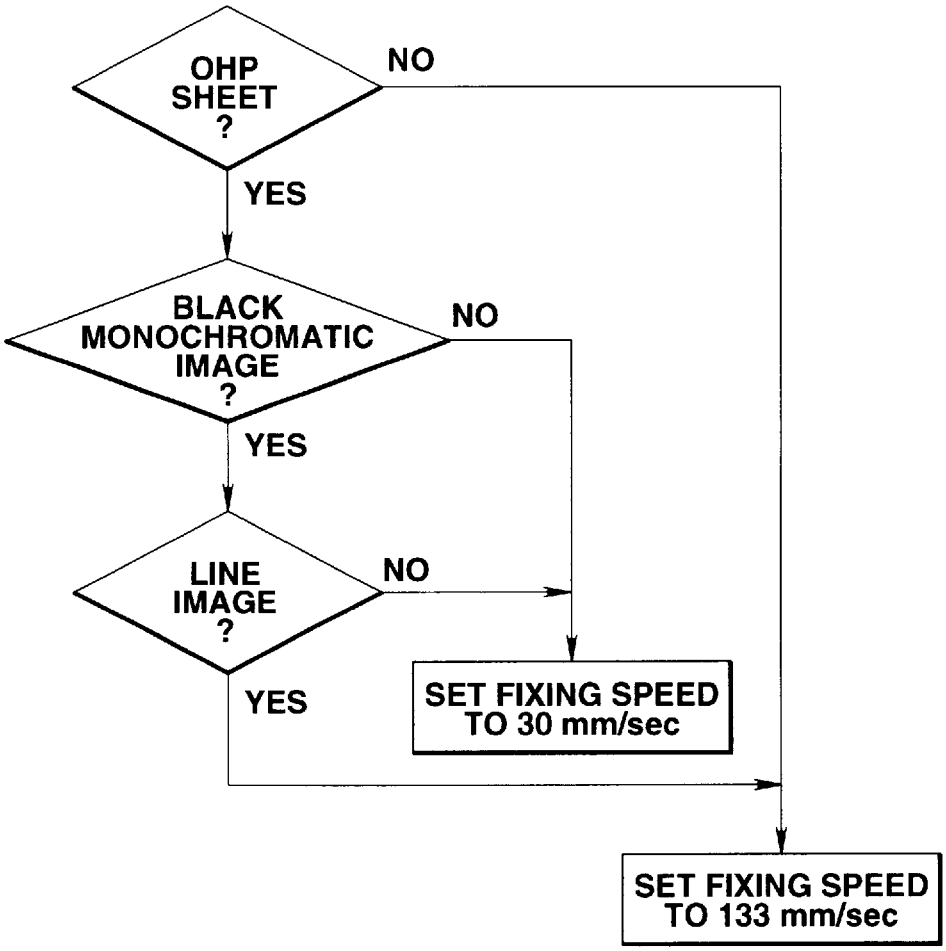
FIG. 3 is a flowchart illustrating the operation of the first embodiment.

Accordingly, in the present embodiment, as shown in FIG. 3, even when using a light-transmitting resin-like transfer material, such as an OHP sheet or the like, in the case of a black monochromatic line image, the fixing speed is set to the same value as the fixing speed of 133 mm/sec for paper or the like. On the other hand, the fixing speed of a light-transmitting resin-like transfer material, such as an OHP sheet or the like, when forming a color image comprising at least one of elementary colors, i.e., cyan, yellow and magent, or when forming a black monochromatic image different from a line image is set to the conventional value of 30 mm/sec.

According to the above-described arrangement, even when using a light-transmitting resin-like transfer material, such as an OHP sheet or the like, in the case of a black monochromatic line image, it is possible to increase the processing speed of the entire image forming processing to the same value as in the case of using paper, and to obtain a processing speed of 7 sheets per minute.

Since character portions and line portions of such an image do not transmit light, characters and lines are clearly observed when projecting the image onto a screen.

In the present embodiment, the determination whether or not the concerned image is a character or line image is automatically performed according to a known image reading and processing technique. However, the determination may be performed by assigning a corresponding portion on an operation panel (not shown) by the operator.

Formation of a black monochromatic image is set by assigning a corresponding portion on the operation panel by the operator, and the fixing speed is determined by control means, such as a CPU (central processing unit) or the like, based on the set information.

As described above, even when using a light-transmitting resin-like transfer material, such as an OHP sheet or the like, in the case of black monochromatic images, it is important to increase the fixing speed, i.e., the processing speed of the entire image forming processing, to the same value as in the case of using paper or the like for character or line images, because such images occupy a large percentage of black monochromatic images.

When forming a character or line image on an OHP sheet together with a color image, or when forming a black monochromatic image different from a line image on an OHP sheet, fixing is performed at the conventional low speed (the second speed). Hence, a sufficient light-transmitting property is obtained, and an image having no problem in gradation, a color-producing property and the like is obtained.

Second Embodiment

Next, a second embodiment of the present invention will be described. A description will be omitted for the same items as in the first embodiment.

The second embodiment differs from the first embodiment in that formation of a black monochromatic image is automatically determined using image recognition means or the like.

That is, when reading an original by the original-image reading device (the original-mount glass 70, the tungsten halogen lamp 72 and the image reading sensor 73) described in the first embodiment, if it is determined that a black monochromatic original-image is a black monochromatic line image, or if a transfer material is assigned or detected while being conveyed to be a light-transmitting resin-like transfer material, such as an OHP sheet or the like, fixing is performed with the fixing speed of 133 mm/sec (the first speed) which is the same as the speed when using an opaque transfer material, such as paper or the like.

The determination whether or not the concerned image is a black monochromatic image may be performed not only during a reading operation as in the above-described case, but also by recognizing that only the black developing unit approaches the drum during development.

In an apparatus for forming an image based on an image signal from a computer instead of performing a copying operation by reading an original-image on an original, the operation when the image signal output from the computer represents only a black line image may be the same as that described above.

As described above, in the second embodiment, the same effects as in the first embodiment are obtained.

In the above-described first and second embodiments, the order of determination by first determination means for determining whether or not the concerned transfer material has a light-transmitting property, second determination means for determining whether or not the concerned image is a black monochromatic image, and third determination means for determining whether or not the concerned image is a line image may be arbitrary.

Figure 4:
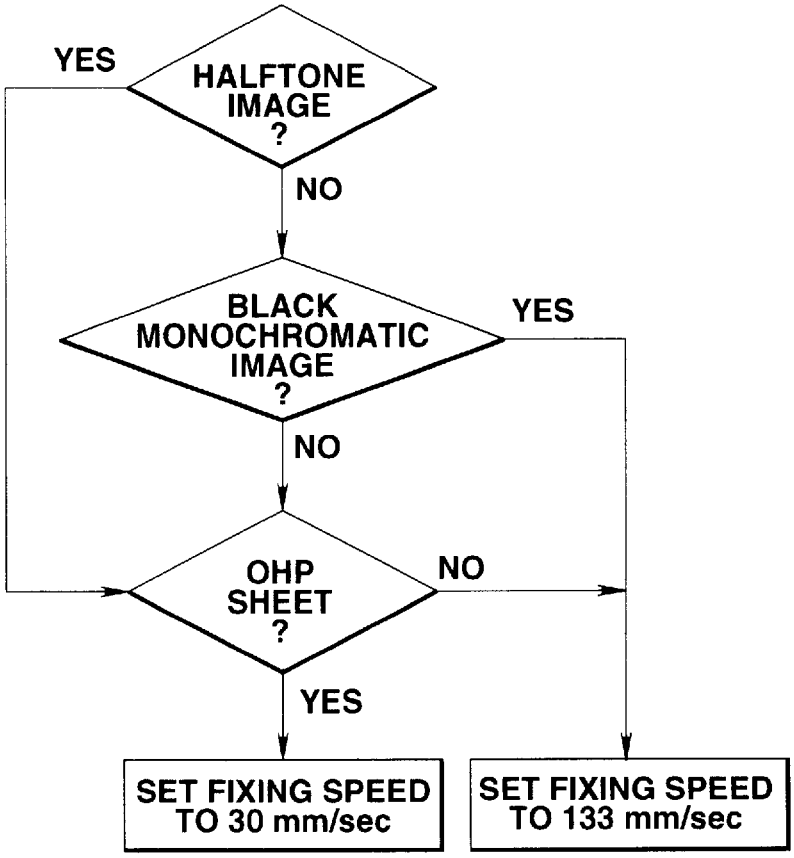
FIG. 4 is a flowchart illustrating the operation of a second embodiment of the present invention.

As shown in FIG. 4, the third determination means may be replaced by determination means for determining whether or not the concerned image is a halftone image.

The halftone image indicates an image in which pixels constituting the image have at least three values, or an image in which gradation is represented by the density of binary color pixels.

In the case of such a halftone image, the reproducibility of the image is degraded even for a black monochromatic image if light is not allowed to be transmitted by sufficiently fusing the toners.

That is, in the case of an image in which pixels have at least three values, a delicate difference in the density between pixels cannot be reproduced if light is not transmitted through the toner layer, and a blackish image is obtained. In the case of a halftone image comprising binary pixels, also, halftone cannot be well reproduced if light is not transmitted through the toner layer.

Third Embodiment

Next, a third embodiment of the present invention will be described. A description will be omitted for the same items as in the first embodiment.

In the third embodiment, the fixing speed of a light-transmitting resin-like transfer material, such as an OHP sheet or the like, can be switched between 133 mm/sec and 30 mm/sec in accordance with an instruction from an operation panel of a computer. Only in the case of a black monochromatic output image, the fixing speed can be selected by determining whether or not the image is a halftone image.

Accordingly, by determining whether or not the concerned image is a halftone image only when forming a black monochromatic image using a light-transmitting resin-like transfer material, such as an OHP sheet or the like, fixing at a high speed or fixing at a low speed can be selected. By thus allowing to select the fixing speed, a black halftone image, such as a black-and-white photograph, i.e., an image having gradation, is subjected to low-speed fixing to provide a light-transmitting property, and an image which does not require a light-transmitting property, i.e., an image which is not a halftone image, such as a character image, a graph or the like, is subjected to high-speed fixing to increase the processing speed.

Since high-speed fixing is prohibited for a color monochromatic image comprising cyan, magenta or the like, and for a color image comprising at least two colors, a failure in the obtained copy does not occur. By performing low-speed fixing for a full-color image in which toners of four colors are laminated, offset due to insufficient heating, i.e., so-called cold offset, does not occur.

That is, the present invention has the feature that, when forming a black monochromatic image on a light-transmitting transfer material, the fixing speed can be selected in accordance with the kind of the image.

According to the present invention, while forming a line image on a transfer material so as to provide a clear projected image, the projected image of a halftone image can have excellent reproducibility.

As described above, according to the present invention, even when using a light-transmitting resin-like transfer material, the fixing speed can be increased in the case of a black monochromatic line image. Hence, it is possible to increase the number of formed images per unit time, and also to provide a clear projected image. When forming a color image other than a black image or a black monochromatic halftone image on a light-transmitting resin-like transfer material, the toner is sufficiently heated and fused by reducing the fixing speed to provide a sufficient light-transmitting property. It is thereby possible to provide a projected image formed by transmitting light through the toner image with an excellent color-producing property.

In the above-described embodiments, a light-transmitting resin-like transfer material, such as an OHP sheet or the like, can be detected according to a conventional known method, for example, a method in which the user selects the material on an operation panel by depressing a button or the like, or a method of automatically detecting the material while being conveyed using a transmission sensor or the like.

Although in the above-described embodiments, the case of the operation speeds of 133 mm/sec and 30 mm/sec has been described, the speeds are not limited to such values, but any appropriate values may be selected within the spirit and scope of the appended claims.

The individual components shown in outline in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

unfixed-image forming means for forming onto a recording material an unfixed image having a plurality of colors;

fixing means for fixing the unfixed image by heating the recording material bearing the image, said fixing means being capable of fixing the unfixed image on the recording material in a first mode or in a second mode which heats the recording material more than said first mode;

light-transmitting-property recognition means for recognizing whether or not the recording material has a light-transmitting property; and black-monocolor recognition means for recognizing whether or not the image to be fixed by the fixing means is a black monochromatic image, wherein, when said image forming apparatus recognizes that the recording material has a light-transmitting property using said light-transmitting-property recognition means and that the image to be fixed is a black monochromatic image using said black-monocolor recognition means, said fixing means can fix the unfixed image in said first mode or in said second mode based on information relating to an image to be fixed by said fixing means.

2. An apparatus according to claim 1, wherein said light-transmitting-property recognition means recognizes whether or not the recording material has a light-transmitting property by setting of an operator operating said image forming apparatus.

3. An apparatus according to claim 1, wherein said light-transmitting-property recognition means automatically recognizes whether or not the recording material has a light-transmitting property.

4. An apparatus according to claim 1, wherein said black-monocolor recognition means recognizes whether or not the image to be fixed is a black monochromatic image by setting of an operator operating said image forming apparatus.

5. An apparatus according to claim 1, wherein said black-monocolor recognition means automatically recognizes whether or not the image is to be fixed a black monochromatic image.

6. An apparatus according to claim 1, further comprising halftone-image recognition means for recognizing whether or not the image to be fixed by said fixing means is a halftone image, wherein, when said image forming apparatus recognizes that the recording material has a light-transmitting property using said light-transmitting-property recognition means and that the image to be fixed is a black monochromatic image using said black-monocolor recognition means, said fixing means fixes the unfixed image in said second mode when the image to be fixed is recognized to be a halftone image and fixes the unfixed image in said first mode when the image to be fixed is recognized not to be a halftone image by said halftone-image recognition means.

7. An apparatus according to claim 6, wherein said halftone-image recognition means automatically recognizes whether or not the image to be fixed is a halftone image.

8. An apparatus according to claim 6, wherein said halftone-image recognition means recognizes whether or not the image to be fixed is a halftone image by setting of an operator operating said image forming apparatus.

9. An apparatus according to claim 1, further comprising line-image recognition means for recognizing whether or not the image to be fixed by said fixing means is a line image, wherein, when said image forming apparatus recognizes that the recording material has a light-transmitting property using said light-transmitting-property recognition means and that the image to be fixed is a black monochromatic image using said black-monocolor recognition means, said fixing means fixes the unfixed image in said first mode when the image to be fixed is recognized to be a line image and fixes the unfixed image in said second mode when the image to be fixed is recognized not to be a line image by said line-image recognition means.

10. An apparatus according to claim 9, wherein said line-image recognition means automatically recognizes whether or not the image to be fixed is a line image.

11. An apparatus according to claim 9, wherein said line-image recognition means recognizes whether or not the image to be fixed is a line image by setting of an operator operating said image forming apparatus.

12. An apparatus according to claim 1, wherein, when said image forming apparatus recognizes that the recording material has a light-transmitting property using said light-transmitting-property recognition means and that the image to be fixed is not a black monochromatic image using said black-monocolor recognition means, said fixing means fixes the unfixed image in said second mode.

13. An apparatus according to claim 1, wherein, when said image forming apparatus recognizes that the recording material does not have a light-transmitting property using said light-transmitting-property recognition means, said fixing means fixes the unfixed image in said first mode.

14. An apparatus according to claim 1, wherein said fixing means fixes the unfixed image by conveying the recording material, and the speed of conveying the recording material of said fixing means in said second mode is lower than that in said first mode.

15. An apparatus according to claim 1, wherein the amount of heating per unit area of said fixing means in said second mode is greater than that in said first mode image fixing on the recording material by said fixing means with said first degree of fixing and with said second degree of fixing indicates image fixing by heating the recording material with a first amount of heating per unit area and with a second amount of heating per unit area which is greater than said first amount of heating per unit area.

16. An apparatus according to claim 1, wherein said image forming apparatus comprises an image forming apparatus capable of forming a full-color image obtained by mixing a plurality of piled toners having different colors.

17. An apparatus according to claim 1, further comprising halftone-image recognition means for recognizing whether or not the image to be fixed by said fixing means is a halftone image, wherein, when said image forming apparatus recognizes that the recording material has a light-transmitting property using said light-transmitting property recognition means and that the image to be fixed is a black monochromatic image using said black-monocolor recognition means, said fixing means fixes the unfixed image in said second mode when the image to be fixed is recognized to be a halftone image by said halftone image recognition means.

18. An apparatus according to claim 1, further comprising line-image recognition means for recognizing whether or not the image fixed by said fixing means is a line image, wherein, when said image forming apparatus recognizes that the recording material has a light-transmitting property using said light-transmitting-property recognition means and that the image to be fixed is a black monochromatic image using said black-monocolor recognition means, said fixing means fixes the unfixed image in said second mode when the image to be fixed is recognized not to be a line image by said line-image recognition means.

19. An image forming apparatus comprising:

unfixed-image forming means for forming onto a recording material an unfixed image;

fixing means for fixing the unfixed image on the recording material in a first mode or in a second mode, the degree of fixing in said second mode being greater than that in said first mode;

first determination means for determining whether or not the recording material has a light-transmitting property;

second determination means for determining whether or not the image to be fixed by said fixing means is a black monochromatic image; and third determination means for determining whether or not the image to be fixed by said fixing means is a halftone image, wherein whether the fixing operation is performed in the first mode or in the second mode is selected based on results of the determination by said first, second and third determination means.

20. An apparatus according to claim 19, wherein said first determination means determines whether or not the recording material has a light-transmitting property by setting of an operator operating said image forming apparatus.

21. An apparatus according to claim 19, wherein said first determination means automatically determines whether or not the recording material has a light-transmitting property.

22. An apparatus according to claim 19, wherein said second determination means determines whether or not the image to be fixed is a black monochromatic image based on setting of an operator operating said image forming apparatus.

23. An apparatus according to claim 19, wherein said second determination means automatically determines whether or not the image to be fixed is a black monochromatic image.

24. An apparatus according to claim 19, wherein said third determination means automatically determines whether or not the image to be fixed is a halftone image.

25. An apparatus according to claim 19, wherein said third determination means determines whether or not the image to be fixed is a halftone image based on setting of an operator operating said image forming apparatus.

26. An apparatus according to claim 19, wherein if at least said first determination means and said third determination means determine that the recording material has a light-transmitting property and that image to be fixed is a halftone image, said fixing means fixes the unfixed image in said second mode.

27. An apparatus according to claim 19, wherein if at least said second determination means and said third determination means determine that the unfixed image is a black monochromatic image and that the image to be fixed is not a halftone image, said fixing means fixes the unfixed image in said first mode.

28. An apparatus according to claim 19, wherein, when said first determination means and said second determination means determine that the recording material has a light-transmitting property and that the image to be fixed is not a black monochromatic image, respectively, said fixing means fixes the unfixed image in said second mode.

29. An apparatus according to claim 19, wherein, when said first determination means determines that the recording material does not have a light-transmitting property, said fixing means fixes the unfixed image in said first mode.

30. An apparatus according to claim 19, wherein said fixing means fixes the unfixed image by conveying the recording material, and the speed of conveying the recording material of said fixing means in said second mode is lower than that in said first mode.

31. An apparatus according to claim 19, wherein said fixing means fixes the unfixed image by heating the recording material, and the amount of heating per unit area of said fixing means in said second mode is greater than that in said first mode.

32. An apparatus according to claim 19, wherein said image forming apparatus comprises an image forming apparatus capable of forming a full-color image obtained by mixing a plurality of piled toners having different colors.

33. An image forming apparatus comprising:

unfixed-image forming means for forming an unfixed image on a recording material;

fixing means for fixing the unfixed image formed by said unfixed-image forming means on the recording material in a first mode or in a second mode, the degree of fixing in said second mode being greater than that in said first mode;

first determination means for determining whether or not the recording material has a light-transmitting property;

second determination means for determining whether or not the image to be fixed by said fixing means is a black monochromatic image; and third determination means for determining whether or not the image to be fixed by said fixing means is a line image, wherein whether the fixing operation is performed in the first mode or in the second mode is selected based on results of the determination by said first, second and third determination means.

34. An apparatus according to claim 33, wherein said first determination means determines whether or not the recording material has a light-transmitting property based on setting of an operator operating said image forming apparatus.

35. An apparatus according to claim 33, wherein said first determination means automatically determines whether or not the recording material has a light-transmitting property.

36. An apparatus according to claim 33, wherein said second determination means determines whether or not the image to be fixed is a black monochromatic image based on setting of an operator operating said image forming apparatus.

37. An apparatus according to claim 33, wherein said second determination means automatically determines whether or not the image to be fixed is a black monochromatic image.

38. An apparatus according to claim 33, wherein said third determination means automatically determines whether or not the image to be fixed is a line image.

39. An apparatus according to claim 33, wherein said third determination means determines whether or not the image to be fixed is a line image based on setting of an operator operating said image forming apparatus.

40. An apparatus according to claim 33, wherein if at least said first determination means and said third determination means determine that the recording material has a light-transmitting property and that the image to be fixed is not a line image, said fixing means fixes the unfixed image in said second mode.

41. An apparatus according to claim 33, wherein if at least said second determination means and said third determination means determine that the unfixed image is a black monochromatic image and that the image to be is not the line image, said fixing means fixes the unfixed image in said second mode.

42. An apparatus according to claim 33, wherein, when said first determination means and said second determination means determine that the recording material has a light-transmitting property and that the image to be fixed is not a black monochromatic image, said fixing means fixes the unfixed image in said second mode.

43. An apparatus according to claim 33, wherein, when said first determination means determines that the recording material does not have a light-transmitting property, said fixing means fixes the unfixed image in said first mode.

44. An apparatus according to claim 33, wherein said fixing means fixes the unfixed image by conveying the recording material, and the speed of conveying the recording material of said fixing means in said second mode is lower than that in said first mode.

45. An apparatus according to claim 33, wherein said fixing means fixes the unfixed image by heating the recording material, and the amount of heating per unit area which of said fixing means in said second mode is greater than that in said first mode.

46. An apparatus according to claim 33, wherein said image forming apparatus comprises an image forming apparatus capable of forming a full-color image obtained by mixing a plurality of piled toners having different colors.

47. An image forming apparatus comprising:

unfixed-image forming means for forming an unfixed image on a recording material;

fixing means for fixing the unfixed image formed by said unfixed-image forming means in a first mode or in a second mode, the degree of fixing in said second mode being greater than that in said first mode;

first determination means for determining whether or not the recording material has a light-transmitting property; and second determination means for determining whether or not the image to be fixed by said fixing means is a halftone image, wherein, when said first determination means and said second determination means determine that the recording material has a light-transmitting property and that the image fixed is a halftone image, respectively, said fixing means fixes the unfixed image in said second mode.

* * * * *

UNITED STATES PATENT AND TRADEMARK OFFICE

CERTIFICATE OF CORRECTION

PATENT NO. : 5,809,368

DATED : September 15, 1998

INVENTORS : Takeshi Menjo, et al.

It is certified that error appears in the above-identified patent and that said Letters Patent is hereby corrected as shown below:

COLUMN 3

Line 28, "DESCRIPTION" should read --BRIEF DESCRIPTION--.

COLUMN 7

Line 24, "magent," should read --magenta--.

COLUMN 10

Line 44, "fixed" should read --fixed is--.

COLUMN 11

Line 38, "mode image" should read --mode.--; and
Line 39-44 should be deleted.

COLUMN 14

Line 10, "to be" should read --to be fixed--.

Signed and Sealed this

Twenty-seventh Day of April, 1999

*Attest:*

Q. TODD DICKINSON

*Attesting Officer*

*Acting Commissioner of Patents and Trademarks*